US008303339B2

(12) United States Patent
Montena

(10) Patent No.: US 8,303,339 B2
(45) Date of Patent: Nov. 6, 2012

(54) AUDIO JACK CONNECTOR DEVICE

(75) Inventor: Noah Montena, Syracuse, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 128 days.

(21) Appl. No.: 12/556,512

(22) Filed: Sep. 9, 2009

(65) Prior Publication Data

US 2011/0059648 A1 Mar. 10, 2011

(51) Int. Cl.
*H01R 9/05* (2006.01)

(52) U.S. Cl. ..... 439/584; 439/580

(58) Field of Classification Search ..... 439/579, 439/580, 584

See application file for complete search history.

(56) References Cited

U.S. PATENT DOCUMENTS

| | | | | |
|---|---|---|---|---|
| 2,238,834 | A | | 4/1941 | Travers |
| 2,449,983 | A | | 9/1948 | Devol |
| 2,761,110 | A | | 8/1956 | Edlen et al. |
| 3,184,706 | A | | 5/1965 | Atkins |
| 3,683,320 | A | | 8/1972 | Woods et al. |
| 3,706,958 | A | | 12/1972 | Blanchenot |
| 4,261,632 | A | | 4/1981 | Narozny |
| 4,352,240 | A | | 10/1982 | Komada |
| 4,374,458 | A | | 2/1983 | Komada |
| 4,553,806 | A | * | 11/1985 | Forney et al. ..... 439/277 |
| 4,557,546 | A | | 12/1985 | Dreyer |
| 4,688,877 | A | | 8/1987 | Dreyer |
| 4,789,355 | A | | 12/1988 | Lee |
| 4,799,902 | A | * | 1/1989 | Laudig et al. ..... 439/585 |
| 5,066,248 | A | | 11/1991 | Gaver, Jr. et al. |
| 5,073,129 | A | * | 12/1991 | Szegda ..... 439/585 |
| 5,261,839 | A | | 11/1993 | Franks, Jr. |
| 5,318,458 | A | | 6/1994 | Thorner |
| 5,362,251 | A | | 11/1994 | Bielak |
| 5,470,257 | A | | 11/1995 | Szegda |
| 5,527,190 | A | | 6/1996 | Weingartner |
| 5,890,925 | A | | 4/1999 | Bernardini |
| 5,997,350 | A | | 12/1999 | Burris et al. |
| 6,109,963 | A | | 8/2000 | Follingstad et al. |
| 6,116,945 | A | | 9/2000 | Davis et al. |
| 6,123,567 | A | | 9/2000 | McCarthy |
| 6,149,469 | A | | 11/2000 | Kim |
| 6,153,830 | A | | 11/2000 | Montena |
| 6,179,656 | B1 | | 1/2001 | Wong |
| 6,210,222 | B1 | | 4/2001 | Langham et al. |
| 6,254,430 | B1 | | 7/2001 | Endo et al. |

(Continued)

FOREIGN PATENT DOCUMENTS

DE 4229812 C1 3/1994

OTHER PUBLICATIONS

U.S. Appl. No. 13/209,587, filed Aug. 15, 2011.

(Continued)

*Primary Examiner* — James Harvey
(74) *Attorney, Agent, or Firm* — Schmeiser, Olsen & Watts, LLP

(57) ABSTRACT

An audio jack connector device having an audio jack and a connector, the audio jack having a socket adapted to receive the tip end of the audio plug and the connector adapted to engage a cable, wherein the connector is adapted to mechanically and electrically connect by compression the coaxial cable to the audio jack.

13 Claims, 11 Drawing Sheets

U.S. PATENT DOCUMENTS

| | | | | |
|---|---|---|---|---|
| 6,261,126 | B1 | 7/2001 | Stirling | |
| 6,331,123 | B1 | 12/2001 | Rodrigues | |
| 6,517,379 | B2 | 2/2003 | Leve | |
| 6,558,194 | B2 | 5/2003 | Montena | |
| 6,568,964 | B2 | 5/2003 | D'Addario | |
| 6,575,784 | B1 | 6/2003 | Yamada | |
| 6,644,993 | B2 * | 11/2003 | Victor | 439/175 |
| 6,676,446 | B2 | 1/2004 | Montena | |
| 6,705,884 | B1 | 3/2004 | McCarthy | |
| 6,722,902 | B2 | 4/2004 | Kedzierski | |
| 6,729,912 | B2 | 5/2004 | D'Addario | |
| 6,749,454 | B2 | 6/2004 | Schmidt et al. | |
| 6,764,350 | B2 | 7/2004 | Kosmala | |
| 6,786,774 | B2 | 9/2004 | Haas, II et al. | |
| 6,848,940 | B2 | 2/2005 | Montena | |
| 6,860,760 | B2 | 3/2005 | Endo et al. | |
| 6,884,113 | B1 | 4/2005 | Montena | |
| 6,966,796 | B2 | 11/2005 | Abe et al. | |
| 7,029,326 | B2 | 4/2006 | Montena | |
| 7,048,579 | B2 | 5/2006 | Montena | |
| 7,121,872 | B1 | 10/2006 | Hanks | |
| 7,153,159 | B2 | 12/2006 | Burris et al. | |
| 7,156,695 | B2 | 1/2007 | Holliday | |
| D542,225 | S | 5/2007 | Victor | |
| 7,217,155 | B2 | 5/2007 | Montena | |
| 7,226,320 | B2 | 6/2007 | Abe et al. | |
| 7,311,554 | B1 | 12/2007 | Jackson et al. | |
| 7,458,849 | B2 | 12/2008 | Rodrigues et al. | |
| 7,458,851 | B2 | 12/2008 | Montena | |
| 7,476,119 | B2 | 1/2009 | D'Addario et al. | |
| 7,488,187 | B2 | 2/2009 | Wolf | |
| 7,857,643 | B2 | 12/2010 | Dobler | |
| 7,997,929 | B2 * | 8/2011 | Montena | 439/578 |
| 8,016,615 | B2 | 9/2011 | Montena | |
| 2003/0207620 | A1 | 11/2003 | Haas, II et al. | |
| 2003/0224658 | A1 | 12/2003 | Koch et al. | |
| 2005/0085125 | A1 | 4/2005 | Montena | |
| 2005/0164553 | A1 | 7/2005 | Montena | |
| 2006/0014425 | A1 | 1/2006 | Montena | |
| 2006/0063426 | A1 * | 3/2006 | Khemakhem et al. | 439/580 |
| 2006/0194474 | A1 | 8/2006 | Montena | |
| 2008/0045082 | A1 | 2/2008 | Kuo | |
| 2008/0261445 | A1 | 10/2008 | Malloy et al. | |
| 2009/0186503 | A1 | 7/2009 | Dobler | |
| 2009/0233482 | A1 | 9/2009 | Chawgo et al. | |
| 2010/0144183 | A1 | 6/2010 | Nania et al. | |
| 2010/0203760 | A1 * | 8/2010 | Montena | 439/584 |
| 2011/0039449 | A1 | 2/2011 | Montena | |
| 2011/0059648 | A1 * | 3/2011 | Montena | 439/578 |
| 2011/0059649 | A1 * | 3/2011 | Montena | 439/580 |
| 2011/0300747 | A1 | 12/2011 | Montena | |
| 2011/0306226 | A1 | 12/2011 | Montena | |
| 2011/0306247 | A1 | 12/2011 | Montena | |
| 2012/0003870 | A1 | 1/2012 | Montena | |
| 2012/0094521 | A1 | 4/2012 | Montena | |

OTHER PUBLICATIONS

U.S. Appl. No. 13/231,011, filed Sep. 13, 2011.

U.S. Appl. No. 12/955,978, filed Nov. 30, 2010.

U.S. Appl. No. 13/152,431, filed Jun. 3, 2011.

Office Action (Mail Date May 24, 2012) for U.S. Appl. No. 13/157,763, filed Jun. 10, 2011.

* cited by examiner

AUDIO JACK CONNECTOR DEVICE

CROSS REFERENCE TO RELATED APPLICATIONS

This application is related to U.S. patent application Ser. No. 12/540,683, filed Aug. 13, 2009, which is hereby incorporated by reference in its entirety.

TECHNICAL FIELD

Embodiments of the present invention relate generally to coaxial cable connectors, and more particularly to, audio jack compression connectors.

BACKGROUND

Currently, two-conductor tip-sleeve (TS) audio connectors, also known as audio plugs and phone plugs, are widely available as part of pre-made jumper assemblies and also as field installable connector/cable kits. Pre-made assemblies are of good to excellent build quality, but are not always convenient in length. Either they are too long and create unnecessary loss in a studio set-up, or they are too short and not repairable in a live performance or road set-up. Field installable connectors solve the needs of custom preparations and make it easier to repair a damaged end, but they require clumsy set-screw connections, which often become loose over time and require bulky connector bodies to house the components, or solder, which requires soldering gear, both which can be a nuisance to use.

Another problem with current connectors, factory installed or otherwise, is that the internal wire terminations are two non-coaxial individual terminals requiring non-coaxial break-out of the cable end, losing any shielding benefits of the cable conductors being coaxial.

Currently, there are available preassembled coaxial cable connectors for use with F connectors, such as axially-compressible F connectors that are used to attach a coaxial cable to another object, such as an appliance or junction, having a terminal adapted to engage the coaxial cable connector. After an end of the coaxial cable is trimmed using one of several known cable preparation techniques, the trimmed end of the coaxial cable is inserted into a back end of the connector. Then, the coaxial cable connector is axially compressed using one of several known installation tools, and the coaxial cable connector and the coaxial cable become permanently attached to each other. Although such preassembled compressible connectors are known for use with F connectors, there are no suitable preassembled compressible phone plug connectors available on the market.

U.S. Pat. No. 6,786,774 is directed to a two-conductor cable and phone plug assembly that requires assembly of components during installation. The metal band that is used to crimp the shield of the coaxial cable is a loose piece that could be easily dropped or lost.

There remains a need to provide solderless connectors for audio jacks. It would be beneficial to provide audio jack connectors for coaxial cables that continue the coaxial relationship of the two conductors inside the connector. It would be advantageous to provide audio jack connectors with reduced length to reduce strain and stress in the cable during use. It would be beneficial to improve the usability of audio jacks in narrowly spaced equipment cabinets.

SUMMARY OF THE INVENTION

It is a primary object of an embodiment of the invention to provide an audio jack connector device having a preassembled audio jack and connector, wherein the audio jack and connector comprise a series of conductors concentrically arranged in the audio jack connector device wherein the connector is adapted to connect the audio jack to a coaxial cable, wherein the coaxial cable comprises a center conductor surrounded by at least a first dielectric, the at least first dielectric being surrounded by at least a first conductive sheath, and the at least first conductive sheath surrounded by a protective outer jacket, wherein the connector is adapted to mechanically and electrically connect by compression the center conductor of the coaxial cable to a first conductor in the series of conductors of the audio jack and connector and the first conductive sheath of the coaxial cable to a second conductor in the series of conductors of the audio jack and connector. The audio jack is adapted for receiving an audio plug having a conductive tip end and a stem.

According to another aspect of the audio jack connector device, the connector connects to the coaxial cable mechanically and electrically by compression. The audio jack connector device is provided in a preassembled single unit configuration prior to installation of the cable. The components or parts of the audio jack and connector may be configured for an interference fit with each other or may be joined in other ways at the factory, such as by soldering or welding certain pieces together. The strength of the connection between the connector device and the cable in the present invention may be greater than the breaking strength of the cable when the cable is fastened therein.

According to a further aspect of the audio jack connector device, the audio jack may be used for purposes of connecting to an audio plug such as a tip sleeve (TS) plug. Audio plugs, also known as phone plugs, are available in various sizes including quarter-inch (6.3 mm) size and in miniaturized versions (3.5 and 2.5 mm). The TS plug is a two-contact plug, most commonly used for audio connections.

According to yet another aspect of the audio jack connector device, the series of conductors comprise a contact body located in the audio jack, the contact body configured for engaging and electrically contacting the center conductor of the coaxial cable and a post located in the connector for electrically contacting the at least first conductive sheath. A retainer connects the audio jack and the connector by an interference or a press fit. The audio jack further comprises a socket body and the connector further comprises a connector body and a fastener. The fastener is in operative engagement with the connector body and the connector body is configured for an interference fit with the post. Upon axial advancement of the fastener, the connector securely fastens to the cable by compression. According to still a further aspect of the audio jack connector device, the post is tubular for receiving the coaxial cable, the tubular post having a first end and a second end, a first flange disposed on the outer surface of the first end and a second flange of greater diameter disposed on the outer surface of the second end.

According to another aspect of the audio jack connector device, the connector body is positioned radially about the tubular post, wherein the connector body is radially spaced about the post to define a first outer cavity between the post and the connector body, the connector body having a first end and a second end, wherein the second end of the connector body abuts the second flange of the post.

According to yet a further aspect of the audio jack connector device, the fastener is located radially about a portion of the connector body, the fastener having an internal wall thickness of varying thickness over three sections, wherein the first section has a constant thickness T1, the second section has a tapered thickness T2, and the third section has a constant thickness T3, wherein T1 is greater than T3 and wherein T2 decreases in thickness from T1 to T3, and wherein the fastener engages the connector body at the tapered thickness of the second section when the fastener is in a first position. The fastener engages the connector body by interference fit at the first section having thickness T1 when the fastener is in a second position, wherein the fastener radially compresses the connector for a compressed fit with the cable in the second position.

According to yet another aspect of the audio jack connector device, the connector body further includes a detent on its outer surface and a plurality of annular serrations disposed on its inner surface, wherein the fastener includes a groove on its inner surface for engaging the detent on the connector body.

According to still a further aspect of the audio jack connector device, the audio jack of the connector device further comprises an insulator sandwiched between the contact body and the socket body.

According to yet another aspect of the audio jack connector device, the contact body comprises a first end and a second end, wherein the first end is adapted to receive the audio plug tip and the second end contains a bore, wherein an electrical socket component is disposed in the bore for providing electrical contact between the contact body and the center conductor of the cable. Another example of a contact body includes a contact body having a spike configuration for making contact with a cable having a stranded center conductor.

According to a further aspect of the audio jack connector device, the connector provides a continuous electromagnetic shield from external electrical signals, wherein the shield extends from the first end to the second end of the connector.

According to a further aspect of the audio jack connector device, the audio jack connector device may also include a nut or similar means for mechanically connecting the connector to a panel.

It is a further embodiment of the present invention to provide an audio jack connector device having a tubular post for receiving the coaxial cable, the tubular post having a first end and a second end, a first flange disposed on the outer surface of the first end and a second flange of greater diameter disposed on the outer surface of the second end, a connector body positioned radially about the tubular post, wherein the connector body is radially spaced about the post to define a first outer cavity between the post and the connector body, the connector body having a first end and a second end, wherein the second end of the connector body abuts the second flange of the post, a fastener located radially inside a portion of the connector body, the fastener having an internal wall thickness of varying thickness over three sections, wherein the first section has a tapered thickness T1, the second section has a constant thickness T2, and the third section has a tapered thickness T3, wherein thickness T3 is less in thickness than thickness T1 and the angle of taper of thickness T3 is greater than the angle of taper of thickness of T1 with respect to the exterior or top side of the fastener; wherein the connector body engages the fastener by interference fit when a cable is disposed in the connector and the fastener is in a second position, the fastener radially compresses the cable for a compressed fit with the cable.

It is another embodiment of the present invention to provide an audio jack connector device having a tubular post for receiving the coaxial cable, the tubular post having a first end and a second end, a first flange disposed on the outer surface of the first end and a second flange of greater diameter disposed on the outer surface of the second end, a connector body having a first end and a second end, a first portion of the first end of the connector body radially spaced about a first portion of the tubular post to define a first outer cavity between the post and the connector body, a second portion of the first end of the connector body configured to fit by interference with a second portion of the tubular post, the second end of the connector body radially disposed on a portion of the socket body, the connector body configured to fit by interference with the socket body, a fastener located radially inside a portion of the connector body, the fastener having an internal wall thickness of varying thickness over three sections, wherein the first section has a tapered thickness T1, the second section has a constant thickness T2, and the third section has a tapered thickness T3, wherein thickness T3 is less than thickness T1 and the angle of taper of thickness T3 is greater than the angle of taper of thickness T1 with respect to the exterior or top side of the fastener, wherein the connector body engages the fastener by interference fit when a cable is disposed in the connector and the fastener is in a second position, the fastener radially compresses the cable for a compressed fit with the cable.

It is still a further embodiment of the present invention to provide an audio jack connector device wherein the audio jack includes a socket body and the connector includes a post, fastener and a retainer, wherein the post is tubular for receiving the coaxial cable, the tubular post having a first end and a second end, a series of serrations disposed on the outer surface of the first end and a second flange of greater diameter disposed on the outer surface of the second end, the post comprising a first inner cavity; the fastener configured for an interference fit with the post, the fastener disposed radially about the tubular post, wherein the fastener is radially spaced about the post to define a first outer cavity between the post and the fastener, the fastener having a first end and a second end, wherein the fastener comprises a series of ridges disposed on the first end and wherein the second end of the fastener abuts the second flange of the post, the retainer configured for an interference or press fit with the post, fastener and the socket body; whereby the fastener joins the connector to audio jack, and wherein the fastener radially engages a cable disposed in the post by radially crimping the series of ridges disposed on the fastener.

It is a further embodiment of the present invention to provide a method of mounting the audio jack connector device to a prepared terminal end of a coaxial cable, having a center conductor surrounded by at least a first dielectric, the first dielectric being surrounded by at least a first conductive sheath, and the first conductive sheath surrounded by a protective outer jacket, the method comprising (a) providing an audio jack connector device comprising an audio jack and a connector, wherein the audio jack comprises a socket body and a contact body positioned in the socket body, the contact body configured for engaging and making electrical contact with the center conductor; wherein the connector comprises a post, connector body, and a fastener, and wherein the post, connector body, and a fastener are configured and dimensioned for an interference fit with each other; wherein a retainer is configured to join the audio jack to the connector preferably by an interference fit; wherein the post comprises a first inner cavity; wherein the outer surface of the post and the inner surface of the connector body comprise a first outer cavity; (b) separating the center conductor and first dielectric from the at least first conductive sheath and outer jacket of the coaxial cable; (c) inserting the separated end of the coaxial cable into the fastener when the fastener is in a first position and advancing the cable to insert the center conductor into the contact body for electrical contact with the contact body and the at least first dielectric into the first inner cavity of the post, and wherein the at least first conductive sheath and protective outer jacket get positioned in the first outer cavity between the post and the connector body; (d) moving the fastener axially from the first position to a second position to seal and grip the at least first conductive sheath and protective outer jacket.

It is another embodiment of the present invention to provide a method of mounting a audio jack connector device to a prepared terminal end of a coaxial cable having a center conductor surrounded by at least a first dielectric, the at least first dielectric being surrounded by at least a first conductive sheath, and the at least first conductive sheath surrounded by a protective outer jacket, the method comprising. (a) providing an audio jack connector device comprising an audio jack and a connector, wherein the audio jack comprises a socket body and a contact body positioned in the socket body, the contact body configured for engaging and making electrical contact with the center conductor; wherein the connector comprises a post and a fastener and wherein the post and the fastener are configured and dimensioned for an interference fit with each other; wherein a retainer is configured to join the audio jack to the connector by an interference fit; wherein the post comprises a first inner cavity; wherein the outer surface of the post and the inner surface of the fastener body comprise a first outer cavity; wherein the fastener comprises a series of ridges on the outer surface thereof; (b) separating the center conductor and first dielectric from the at least first conductive sheath and outer jacket of the coaxial cable; (c) inserting the separated end of the coaxial cable into the fastener when the fastener is in a first position and advancing the cable to insert the center conductor into the contact body for electrical contact with the contact body and the at least first dielectric into the first inner cavity of the post, and wherein the at least first conductive sheath and protective outer jacket get positioned in the first outer cavity between the post and the fastener; (d) radially crimping the series of ridges disposed on the fastener to seal and grip the at least first conductive sheath and protective outer jacket.

The audio jack connector device provides a shield for the center wire throughout the entire connector to prevent noise and interference from external or environmental conductors. Moreover, the shield prevents the signal from the center wire from radiating outside the connector. Additionally, the compactness of the connector allows closer spacing between audio jack connectors and offers more clearance between conventionally spaced sockets.

BRIEF DESCRIPTION OF THE DRAWINGS

Embodiments of the present invention will be more fully understood and appreciated by reading the following Detailed Description in conjunction with the accompanying drawings, in which.

DETAILED DESCRIPTION

Present invention: means at least some embodiments of the present invention; references to various feature(s) of the "present invention" throughout this document do not mean that all claimed embodiments or methods include the referenced feature(s).

As will be appreciated, an embodiment of the present invention provides an audio jack connector device 10 as shown in FIGS. 1-7. Audio jack connector device 10 includes an audio jack 12 at one end and a connector 14 at the opposite end. Device 10 is preferably provided as a preassembled configuration to ease handling and installation during use.

Figure 2:
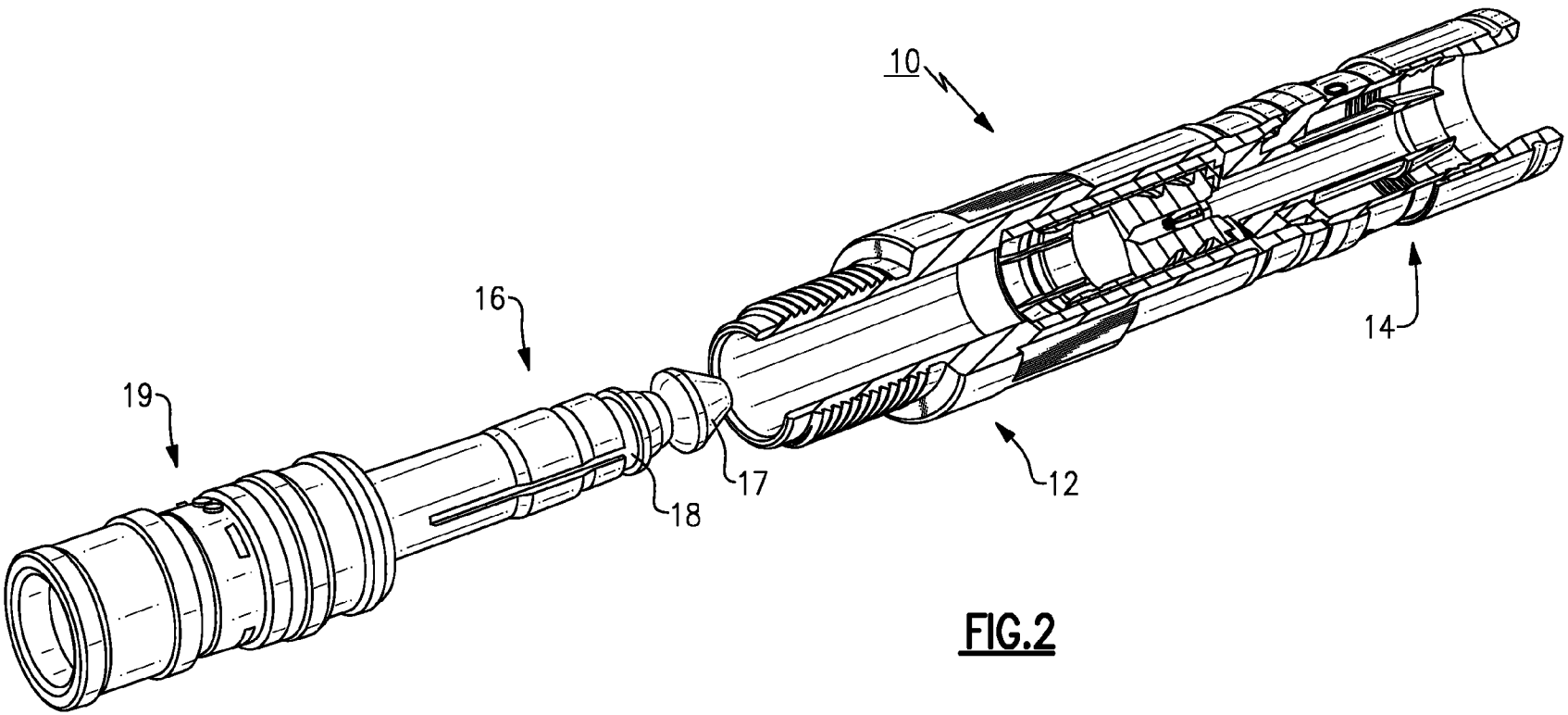
FIG. 2 is a sectional view of the audio jack connector device of FIG. 1 with an audio plug.

Connector 10 connects an audio plug 16, shown in FIG. 2, having a tip 17 and a stem 18, to a coaxial cable (shown in FIG. 7) by insertion of audio plug 16 into audio jack 12. Audio plug 16 is also shown with a coaxial cable connector 19, which is the subject of commonly owned, copending application Ser. No. 12/540,683, filed Aug. 13, 2009, the contents of which are hereby incorporated by reference. Audio plug 16 and the coaxial cable connector portion 19 may be a single, integral component.

A coaxial cable is installed within connector 14 by means of compression without the need for soldering, crimping or tooling. The coaxial cable can be a known type having an electrical center conductor surrounded by and spaced radially inwardly from a braid conductor or conductive sheath by a foil and an insulator core. A dielectric covering or sheathing jacket surrounds the braid and includes the outermost layer of the cable. The cable may include several layers of conductive sheath with or without foil layers. Any form of coaxial cable (e.g., RG6, headphone wire) may be used herein and it is not limited to that just described.

The type of compression used in connector device 10 may be any form including but not limited to configurations set forth in U.S. Pat. Nos. 6,558,194, 6,153,830, 5,470,257 and 6,261,126, all of which are hereby incorporated by reference. It is important that the compression configuration used herein is easily assembled and may be preassembled as a single or unitary configuration prior to installation. Connector 10 includes a number of components that fit, press or snap together without the need for soldering. The shape and configuration of the components or pieces that make up connector 10 may vary depending upon the way the pieces fit together.

It is preferable that the components of the embodiments of the device of the present invention fit together by interference fit or compression, which can be achieved by friction after the parts are pushed together rather than by other means of fastening. "Interference" refers to the fact that one part slightly interferes with the spatial location of another, and commonly includes arrangements referred to as a press fit.

Figure 3:
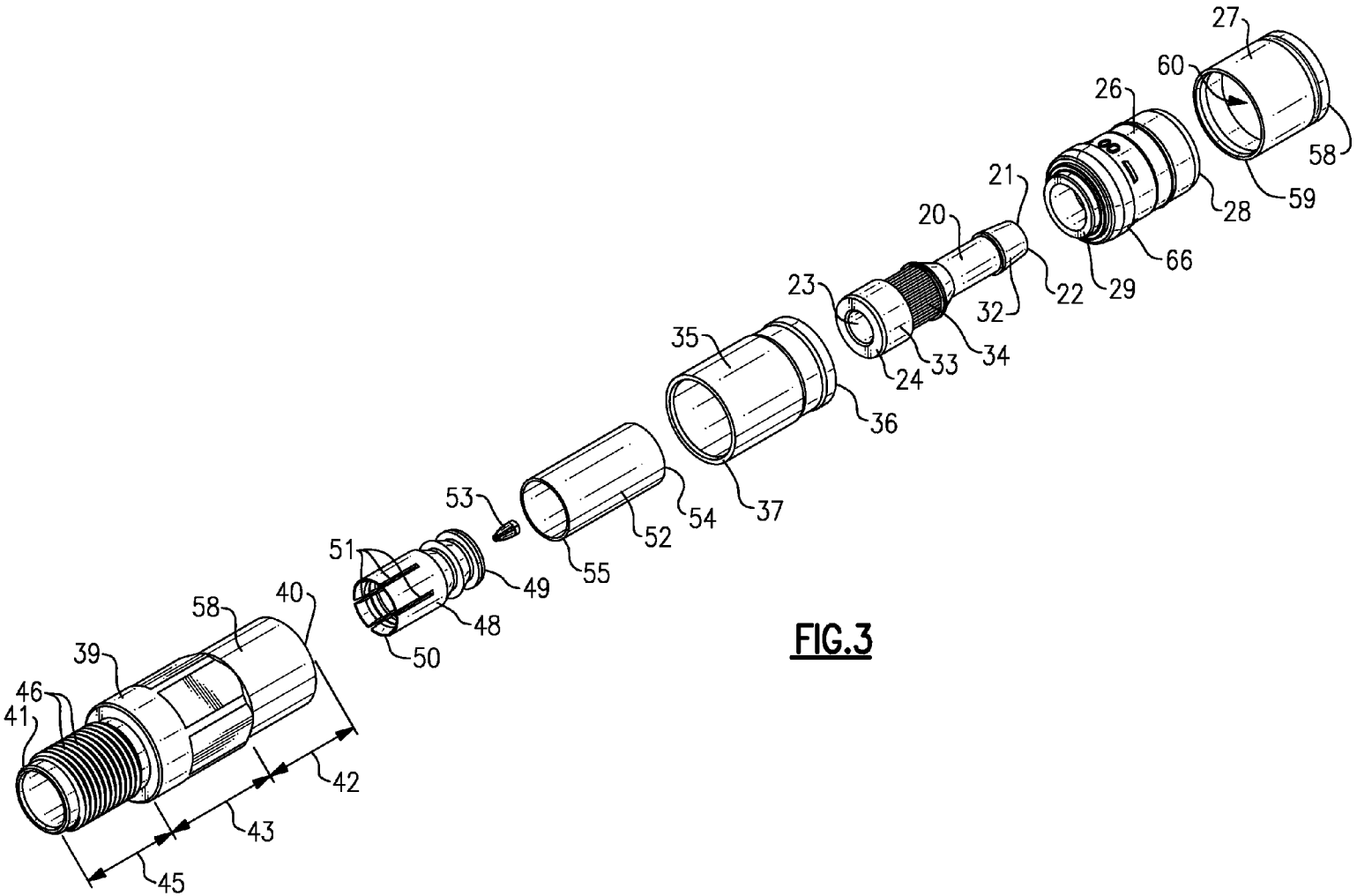
FIG. 3 is an exploded perspective view of the audio jack connector device of FIG. 1.
Figure 4:
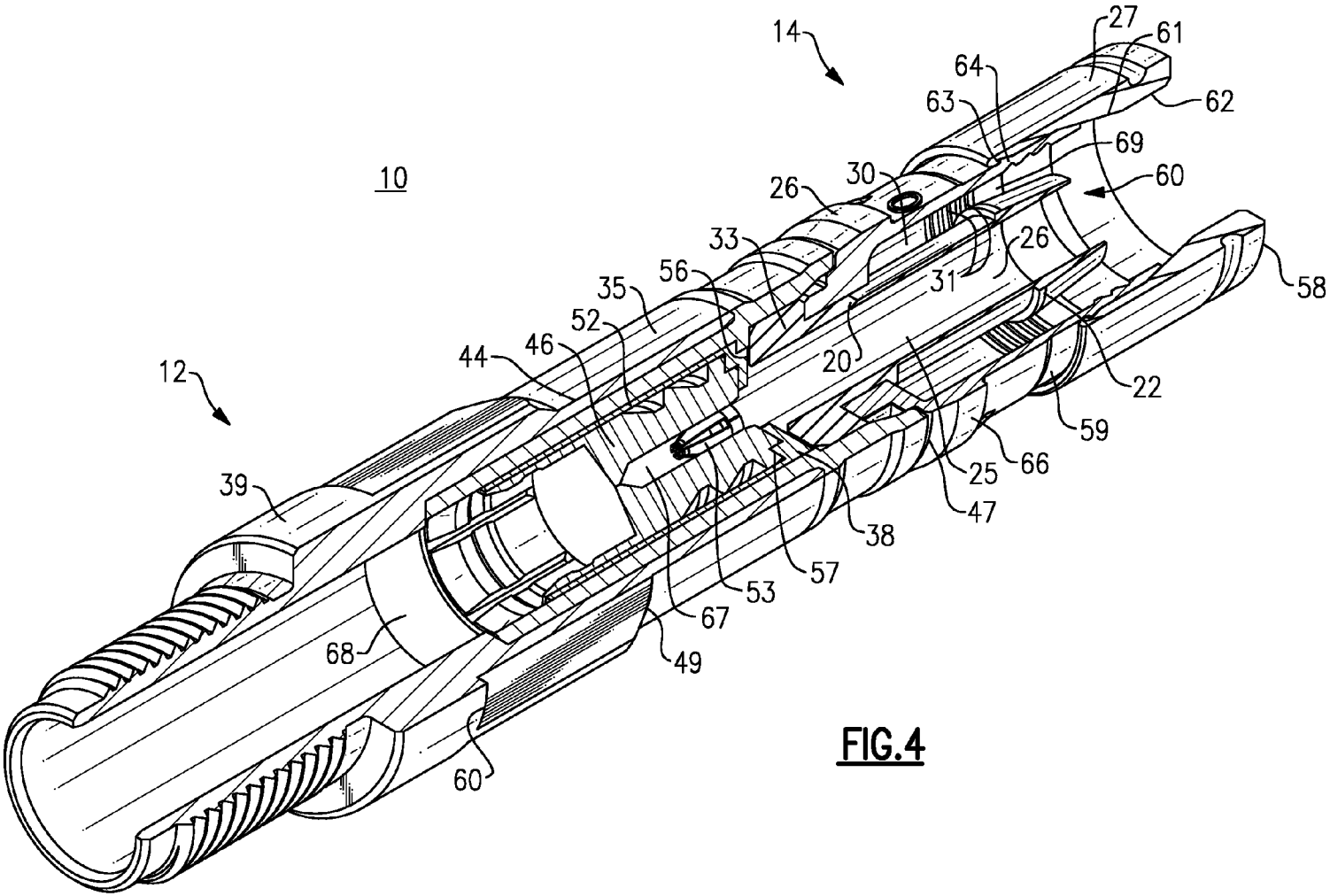
FIG. 4 is a sectional view of the audio jack connector device of FIG. 1.
Figure 5:
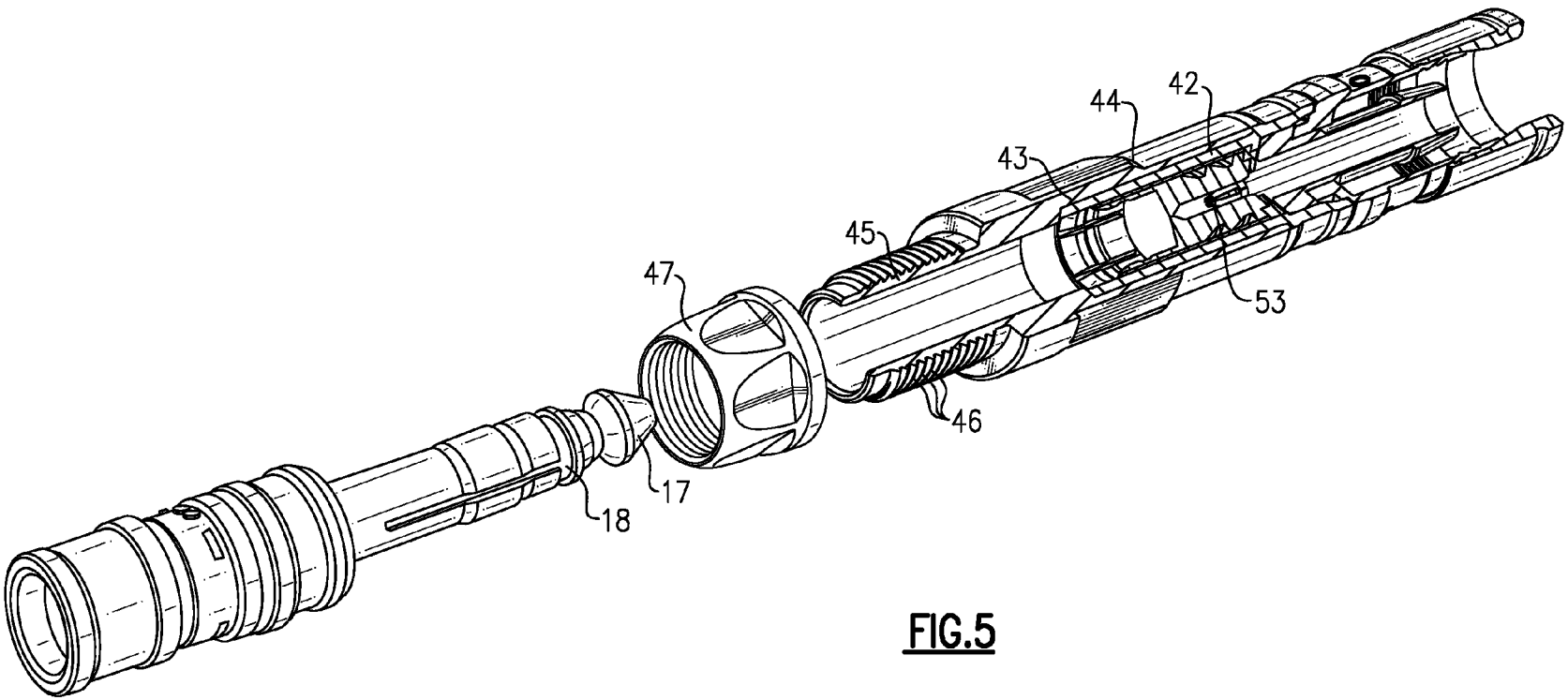
FIG. 5 is a sectional view of the audio jack connector device of FIG. 1 with an audio plug.

FIGS. 1 through 7 illustrate but one example of a configuration used herein to create connector device 10. Reference is made to FIG. 3, which is an exploded view of audio jack connector device 10 and FIG. 4, which shows a sectional view of connector device 10. Connector device 10 is configured to accommodate receiving the prepared end of a coaxial cable.

Connector device 10 includes a post or tubular body 20 for receiving a coaxial cable. Post 20 has a first opening 21 at first end 22 and a second opening 23 at second end 24 that defines a first inner cavity 25. Prior to insertion into post 20, the coaxial cable is prepared by removing various layers to expose an end of the center conductor, insulator core and foil. An end portion of the braid conductor is folded over the sheathing jacket.

Connector device 10 further includes a connector body 26 and a compression ring or fastener 27. Connector body 26 includes a first end 28 and a second end 29 and is radially spaced about post 20 to define a first outer cavity 30 accessible via an opening 69 at a first end 28 in connector body 26. First outer cavity 30 is open at the first end 28 and closed at the opposite or second end 29 of connector body 26.

Preferably, connector body 26 and post 20 are separate components in connector 10, wherein connector body 26 is press fitted onto the outer surface of post 20. Post 20 is fabricated of a conductive material such as brass and connector body 26 may be fabricated of a plastic or metal or other suitable material. Preferably, connector body 26 is formed of brass or a copper alloy for ease of machining. In an alternative embodiment, connector body 26 and post 20 can be formed integrally as a single piece.

The inner surface or inner wall of the connector body 26 may include annular serrations 31 disposed opposite the post 20. Similar serrations are illustrated and described in U.S. Pat. No. 5,073,129, which is incorporated herein by reference in its entirety. Post 20 and annular serrations 31 of connector body 26 provide for a continuous environmental seal and grip on the braid and sheathing jacket of the cable when all components of connector 10 are in place. A raised lip or flange 32 at first end 22 on the outer surface of post 20 further aids in the retention of the braid and sheathing jacket of the cable. The outer surface of second end 24 on post 20 includes a second raised lip or flange 33 of larger outer diameter than the outer diameter of flange 32. Flange 33 abuts second end 29 of connector body 26 preventing connector body 26 from forward movement. Post 20 can also include a ribbed section 34 of smaller outer diameter than the diameter of flange 33 on its outer annular surface proximate flange 33 for engaging connector body 26, which is otherwise attached to post 20 by an interference fit, to insure a secured attachment with connector body 26. Ribbed section 34 prevents rotation of connector body 26 on post 20.

Connector 14 of connector device 10 includes post 20, connector body 22, and fastener 27. Connector 10 also includes a retainer 35 that secures cable engaging section 14 to socket 12 of connector 10. Retainer 35 includes a first end 36 and a second end 37. First end 36 of retainer 35 radially surrounds and engages post 20 and abuts flange 66 of connector body 26. About one third of the distance from first end 36 of retainer 35 is an internally projecting flange or protrusion 38, which abuts second end 24 of post 20. Retainer 35 engages post 20 and connector body 26 of connector 14 of connector device 10 by a press fit or an interference fit. Likewise retainer 35 engages audio jack 12 of connector device 10 by press fit or interference as described below.

Audio jack 12 includes a socket body 39 of tubular configuration having one end 40 positioned radially within retainer 35 and engaged by interference or press fit with retainer 35 and having a second end 41 with an opening for insertion of an audio plug 16. The exterior of socket body 39 is characterized by three sections of different outside diameters. At the first end 40, a first section 42 is of exterior diameter D1. First section 42 having an exterior diameter D1 abuts flange 38 of retainer 25 and fits within retainer 35 by interference or press fit. Second section 43 is characterized by an exterior diameter D2, which is larger than diameter D1, the increase in diameter from D1 to D2 is represented by an exterior stepped section 44, which abuts second end 37 of retainer 35. The third section 45 of socket body 39 has an exterior diameter D3, which is less than diameter D2 and approximately in the same range as diameter D1. Third section 45 may include a series of threads, serrations, or other mechanically interlocking features 46 for optionally mounting connector 10 to a panel (not shown). A nut 47 shown in FIG. 5 may be used to screw and secure the threaded third section 45 to a panel or electrical box, such as in equipment housing or instrument housing, not shown.

A contact body 48 is disposed within socket body 39. Contact body 48 has a first end 49 configured for receiving and making contact with the tip of a coaxial cable and a second end 50 configured for receiving and making contact with the tip 17 of audio plug 16. Contact body 48 may contain slits 51 extending longitudinally thereon to further assist in maintaining audio plug 16 in socket body 39. Slits 51 enable contact body 48 to expand to receive audio plug 16.

As stated above, contact body 48 is configured for electrical contact with the center conductor of a coaxial cable. The internal dimensions may be configured for such contact or an additional component, such as an electrical socket component 53 may be positioned in a bore 67 located in first end 49 for making an electrical connection between contact body 48 and a conductive cable tip (shown in FIG. 7).

Sandwiched between the interior of socket body 39 and the exterior of contact body 48 is an insulator 52. Insulator 52 is engaged radially by socket body 39 by an interference or a press fit. Insulator 52 includes a first end 54 and a second end 55. Insulator 52 includes an inwardly facing flange 56 disposed on the interior surface of end 54 and includes a stepped section 57. Flange 56 of insulator 52 fits by an interference or a press fit with flange 33 of post 20 and stepped section 57 press fits or fits by interference with flange 38 of retainer 35. Contact body 48 is engaged radially by insulator 52 by an interference fit or by a press fit and end 49 of contact body 48 fits flush within and against flange 56 of insulator 52.

Audio jack 12 receives an audio plug 16, which may be any variation of an audio plug, not limited to that shown here. Audio plug 16 can be inserted into audio jack 12 to form an electrical connection with contact body 48, as well as with the socket body 48.

In FIGS. 1-7, fastener 27 is preferably of tubular configuration having a first end 58 and a second end 59, which define a cavity 60 that is smaller in diameter at first end 58, increasing in diameter as the thickness of fastener 27 decreases and maintaining a substantially constant diameter at second end 59. A tapered surface 61 of the inner surface 62 of fastener 27 is provided and the diameter of the thickness of inner surface 62 increases with the taper toward end 58. Tapered surface 61 causes radial compression of fastener 27 upon movement from a preassembled position to a fastened relationship (installed position) with the cable. Fastener 27 fits annularly onto connector body 26 by interference and is further engaged by a groove 63 disposed on the inner surface of the second end 59 of fastener 27 into which a detent 64 located on the outer surface of connector body 26, fits. Although fastener 27 can be coupled to connector body 26 such that fastener 27 can be removed by hand, fastener 27 shown in the Figures is configured relative to the dimensions of connector body 26 so that fastener 27 is securely attached to connector body 26. Such attachment can be obtained by a snap fit or press fit device, or a combination of both.

Figure 1:
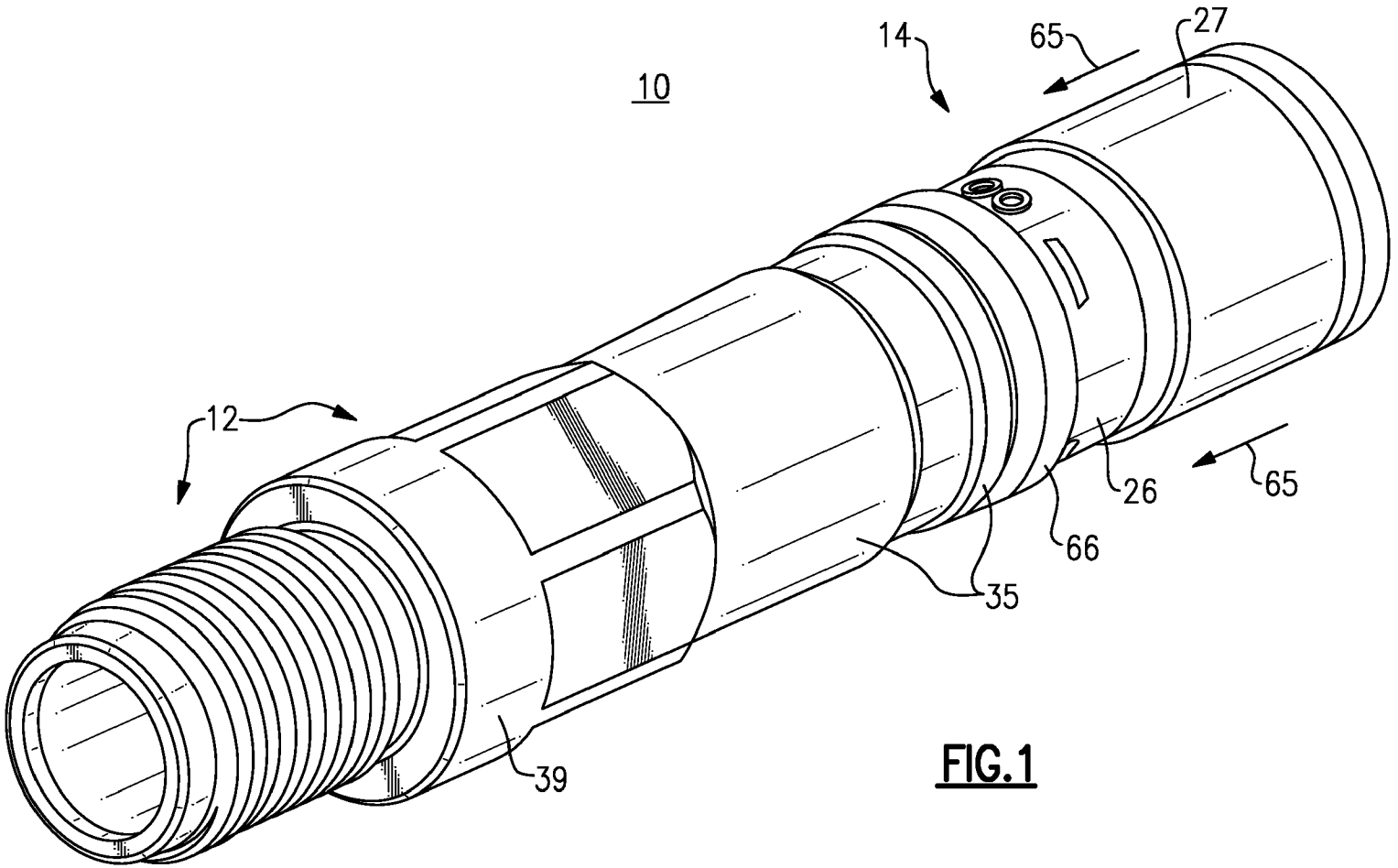
FIG. 1 is a perspective view of an embodiment of a audio jack connector device of the present invention.

Fastener 27 is operably or movably coupled to connector body 26 so as to be capable of being moved on the connector body 26 from a first preassembled configuration as shown in FIG. 1 to a second assembled or installed configuration. After a cable has been prepared and inserted within audio jack connector device 10, fastener 27 may be pushed axially forward over conductor body 26 in the direction of arrows 65 as far forward as flange 66 on connector body 26. Cavity 60 of fastener 27 has a varied diameter, as defined by the thickness of fastener 27 having an initial constant thickness T1 that facilitates sliding of fastener 27 along the outer surface of connector body 26. The thickness begins to increase gradually for a length T2 to a point at which the thickness T3 becomes constant again, the thickness T3 being larger at end 58 in comparison to the thickness T1 at end 59, providing a solid interference fit between fastener 27 and connector body 26 proximate end 58 of fastener 27. Fastener 27 may be fabricated of a metal, plastic or similar material, and it is preferably formed of brass with a nickel or an electroless nickel/Teflon® finish.

Figure 6:
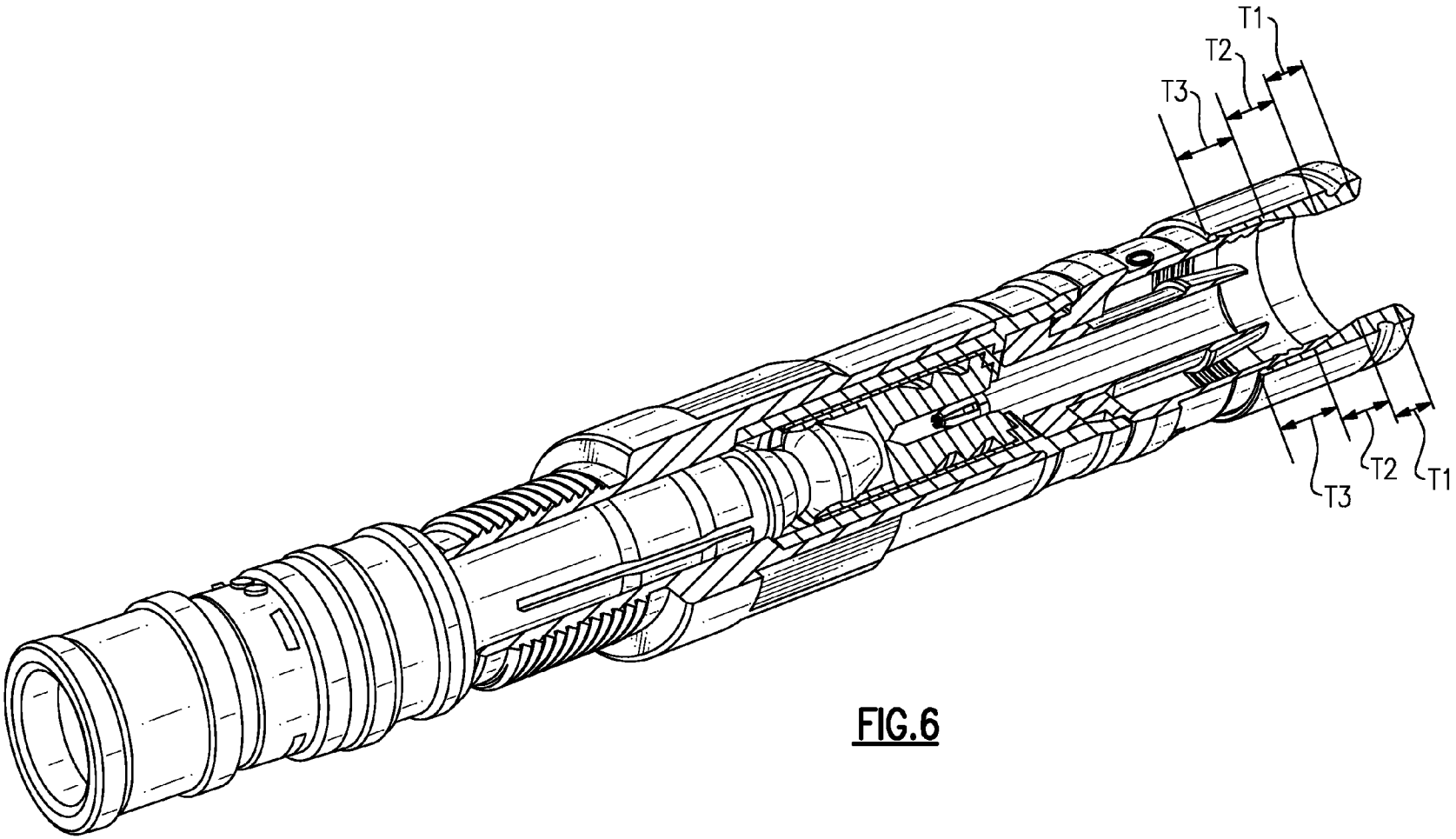
FIG. 6 is a sectional view of the audio jack connector device of FIG. 1 with an audio plug inserted in the connector.

Reference is made to FIG. 6, in order to describe the thickness of fastener 27. Fastener 27 has an internal wall thickness of varying thickness over three sections, wherein the first section has a constant thickness T1, the second section has a tapered thickness T2, and the third section has a constant thickness T3, wherein T1 is greater than T3 and wherein T2 decreases in thickness from T1 to T3, and wherein the fastener engages the connector body at the tapered thickness of the second section when the fastener is in a first position.

When fastener 27 is moved axially forward or in the direction from right to left to a second position as directed by arrows 65 in FIG. 1, fastener 27 engages connector body 26 by interference fit at the first section having thickness T1, wherein the second position radially compresses the connector for a compressed fit with the cable.

In a pre-installed first configuration as illustrated in FIGS. 1 through 7, fastener 27 is fastened onto connector body 26 such that second end 59 of fastener 27 is securely attached to connector body 26 and such that the connector body 26 is gripped to affect a corresponding decrease in the volume of the first outer cavity 30. Thus, connector body 26 is pushed radially inwardly towards the outer surface of post 20. In this manner, fastener 27, in its pre-installed first configuration, is securely fastened to the connector body 26 and is thus in an assembled state during storage, handling, and for later installation on a cable end. This eliminates any danger of any of the components being dropped or otherwise mishandled during handling and installation as is prevalent in known designs, which have many separate components that must be fit together at installation, such as that set forth is U.S. Pat. No. 6,786,774.

Figure 7:
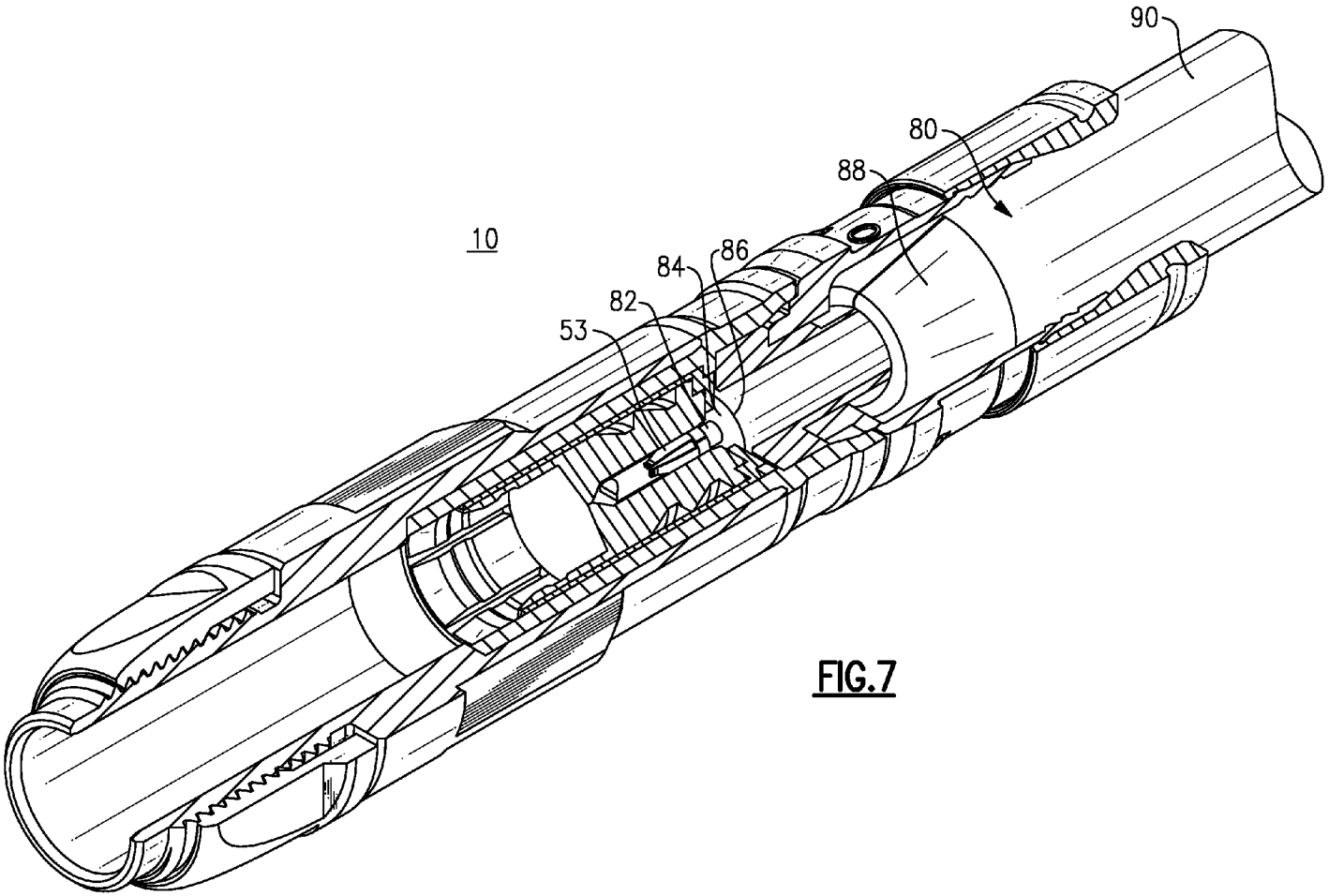
FIG. 7 is a sectional view of the audio jack connector device of FIG. 1 with a coaxial cable positioned therein.

A method of positioning the connector on a coaxial cable is now described with reference to FIG. 7. Connector device 10 is provided as a unitary component that does not need to be disassembled for installation. The end of a coaxial cable 80 is prepared by exposing a central core portion including the center conductor 81, insulator core 84 and foil 86. The outer braid conductor 88 is folded over the end of the outer sheath jacket 90. The prepared end of the coaxial cable can be inserted through the first end 58 of fastener 27 such that the central core portion including the center conductor 81, insulator core 84, and foil 86, is inserted into the first inner cavity 25 of post 20. A socket component 53, positioned in bore 67 of contact body 48 provides a first electrical contact to the cable between the central conductor of the coaxial cable and contact body 48, which also contacts pin 17 of audio plug 16 in a second bore 68 located in contact body 48. The insulator core portion 84 and foil 86 of the cable are prevented from being displaced through second opening 23 of post 20. Also, the outer portion of the cable including the outer braid conductor 88 folded over the end of the outer sheath jacket 90, is received into the first outer cavity 30 through opening 69 of connector body 26, providing the second electrical contact between post 20 and the outer braid 88. Accordingly, electrical connection or conduction is made by compression between device 10 and cable 80 by center conductor 81 and socket component 53 in contact body 48 and by outer conductor 88 and post 20.

Once the insulator core portion 84 of the cable is positioned against the first end 54 of insulator 52, fastener 27 is then advanced or moved axially from its pre-installed first configuration to its second configuration by a standard tool.

Since the diameter of cavity 60 at first end 58 of fastener 27 is slightly smaller than the outer diameter of connector body 26 at first end 28, connector body 26 is concentrically gripped by fastener 27. Connector body 26 may be displaced or moved radially inwardly depending on how much fastener 27 is moved forward onto connector body 26. As a result, the outer portion of the cable is firmly gripped or clamped between the outer surface of post 20 and connector body 26 by radial compression created by an interference fit between all the components. In this manner, post 20 with raised lip 32 fits within the annular serrations 31 of connector body 26 to provide a generally continuous, 360° seal and grip on the outer portion of the cable. Advantageously, this eliminates the need for an O-ring or other seal between connector body 26 and fastener 27, and can accommodate a wide range of cable types and sizes. Thus the need for connectors of various sizes can be avoided with a universal connector of the present invention. Although an O-ring, which may be conductive, or similar seal is not needed, one may be used if it desired.

It should be mentioned that post 20 provides not only good electrical connection for outer braid 88, but also provides a protective electromagnetic shield for central conductor 81, preventing interference from external electrical conductors. The protective electrical shield continues with the socket body 39 by way of retainer 35, extending the length of the connector device 10. Accordingly, the protective shield extends the length of the phone plug connector device 10 due to socket body 39, retainer 35 and post 20. Moreover, post 20 provides the added benefit of adding support and integrity to the connector device 10 providing strength to the cable connection, whereby the tensile or mechanical strength of the connector device 10 may be greater than the breaking strength of the cable itself. Depending on the tensile or mechanical strength of the connector device relative to the cable, if the connector device 10 and cable 80 are subjected to stress, strain or other pressure, the cable 80 may break or tear before the connector device 10 fractures or before the cable is released from the grip of the connector device. The connector devices described herein do not create stress concentrations, but distribute the stress more evenly around the circumference of the cable.

Figure 8:
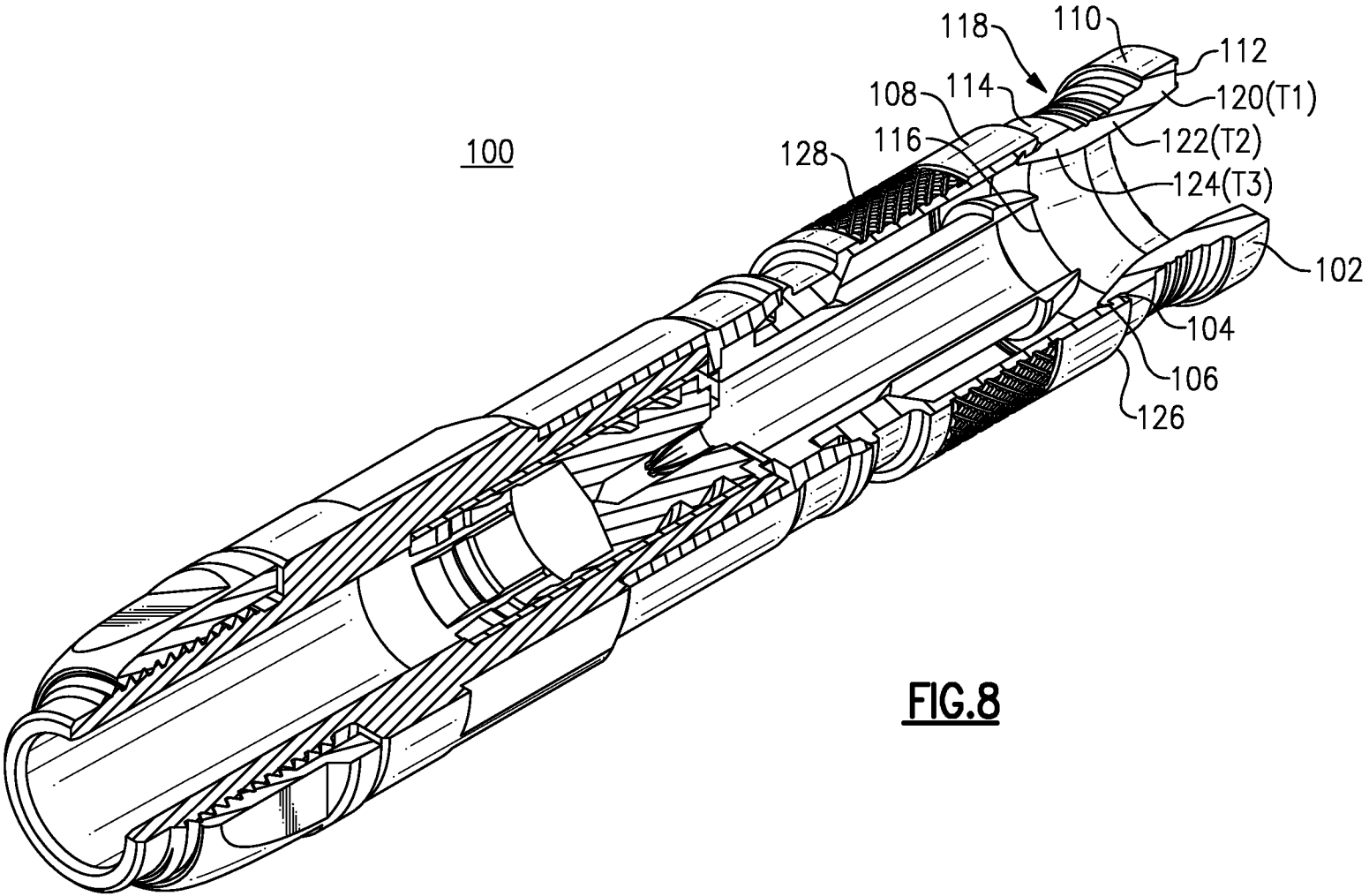
FIG. 8 is a perspective view of another embodiment of the audio jack connector device of the present invention.

FIG. 8 shows another embodiment of the present invention. An audio jack connector device 100 shown in FIG. 8 is similar to device 10 shown in FIGS. 1 through 7. In device 100 a fastener 102 includes a detent 104 which locks into groove 106 shown located on connector body 108. The mechanical fit maintains fastener 102 on connector body 108 when in preassembled, preinstalled configuration. The exterior surface of fastener 102 includes a first flange 110 on a first end 112 and a second flange 114 on second end 116. A ribbed section 118 on the exterior surface of fastener 102 assists with maintaining fastener 102 within connector body 108 when fastener 102 is moved axially forward within connector body 108 over a cable (similar to the cable shown in FIG. 7) to compress and maintain a cable in place. Moreover, the inner diameter of fastener 102 varies over the length of fastener 102. First end 112 includes a first taper 140 with very slight increase in thickness from end 112 inwardly (Tl). Fastener 102 exhibits a constant thickness 122 midway through fastener 102 (T2) to a point at which the thickness includes a second taper 124, whereby the thickness decreases from the constant thickness to end 116 (T3). The second taper 124 eases the sliding of fastener 102 over a cable inserted into the connector when moved from this first position to a second position over the cable and constant thickness 120 fits against and maintains the cable in place when fastener 102 is in a second position. Fastener 102 is moved forward and axially over a cable inside connector body 102 to a second position. In the second position, first flange 110 abuts the first end 126 of connector body 108. Connector body 108 may include a textured or knurled surface 128 for easy gripping and handling. The remainder of the components are the same of those shown in device 10 in FIGS. 1 through 7.

Figure 9:
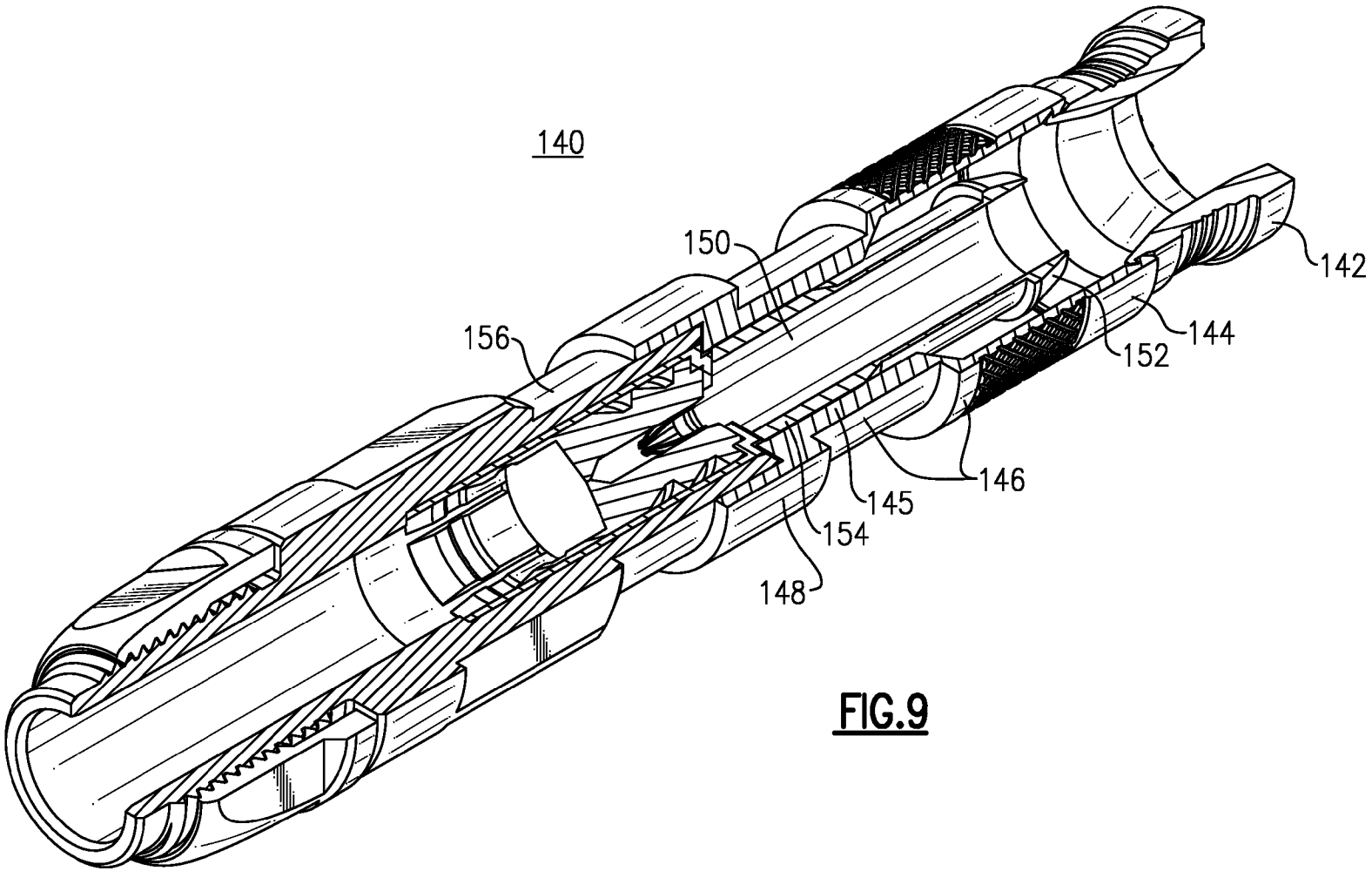
FIG. 9 is a perspective view of another embodiment of the audio jack connector device of the present invention.

FIG. 9 shows an additional embodiment of the present invention. An audio jack connector device 140 shown in FIG. 9 is similar to device 100 shown in FIG. 8. In device 140, a fastener 142 is similar to fastener 102 in the embodiment shown in FIG. 8. Device 140 includes a connector body 144, which includes a body section 146 and a retainer section 148 in a single unit. The combination of body section 146 and retainer section 148 in a single unit may be accomplished by machining from a single piece of metal stock or by joining two separate pieces together by welding, soldering, adhesive bonding or other industrial joining processes. Body section 146 of connector body 144 includes an internal lip or flange section 145 in the interior of the connector body 144. Post 150 includes a first flange 152 and a second flange 154, in which second flange 154 press fits or fits by interference within body section 146 at lip 145. Retainer section 148 of connector body 144 is disposed radially on socket body 156. The remainder of the components are similar to embodiments shown in FIGS. 1 and 8.

Figure 10:
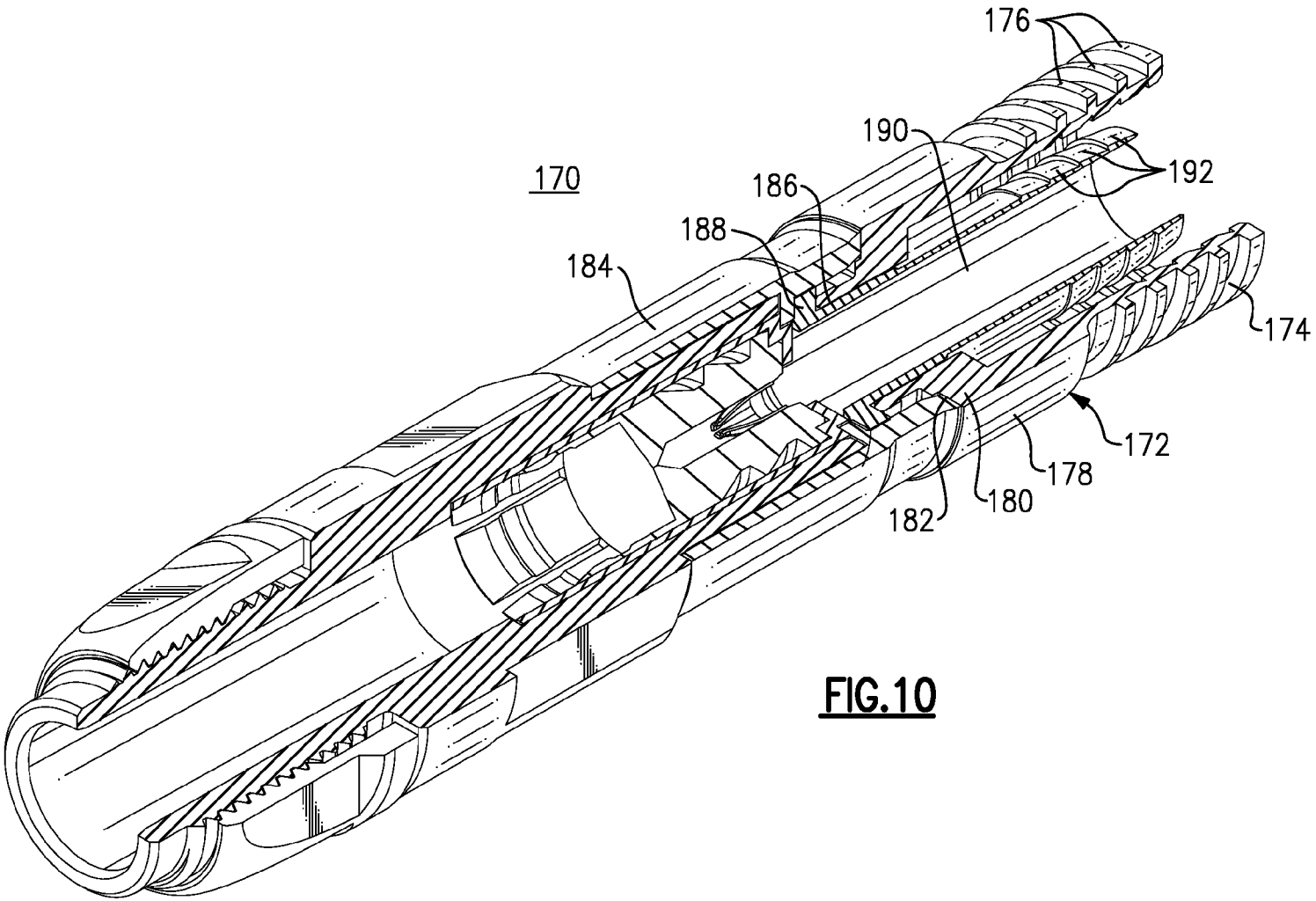
FIG. 10 is a perspective view of another embodiment of the audio jack connector device of the present invention.

FIG. 10 shows a further embodiment of the present invention. An audio jack connector device 170 shown in FIG. 10 is similar to device 100 shown in FIG. 8. In device 170, a fastener 172 includes a fastener section 174 with a series of ridges 176 and a connector body section 178 in a single unit. A flange 180 on connector body section 178 of fastener 172 abuts the edge of shoulder 182 of retainer 184 and lip 186 on connector body section 178 of fastener 172 abuts a flange 188 on post 190. Post 190 includes a series of serrations 192 to enhance the fastening of the cable section inserted between post 190 and fastener 172. Fastener 172 is shown in preassembled or first position. After a cable is inserted as described above in previous embodiments, fastener section 174 is crimped radially at ridges 176 to fasten to the cable.

Figure 11:
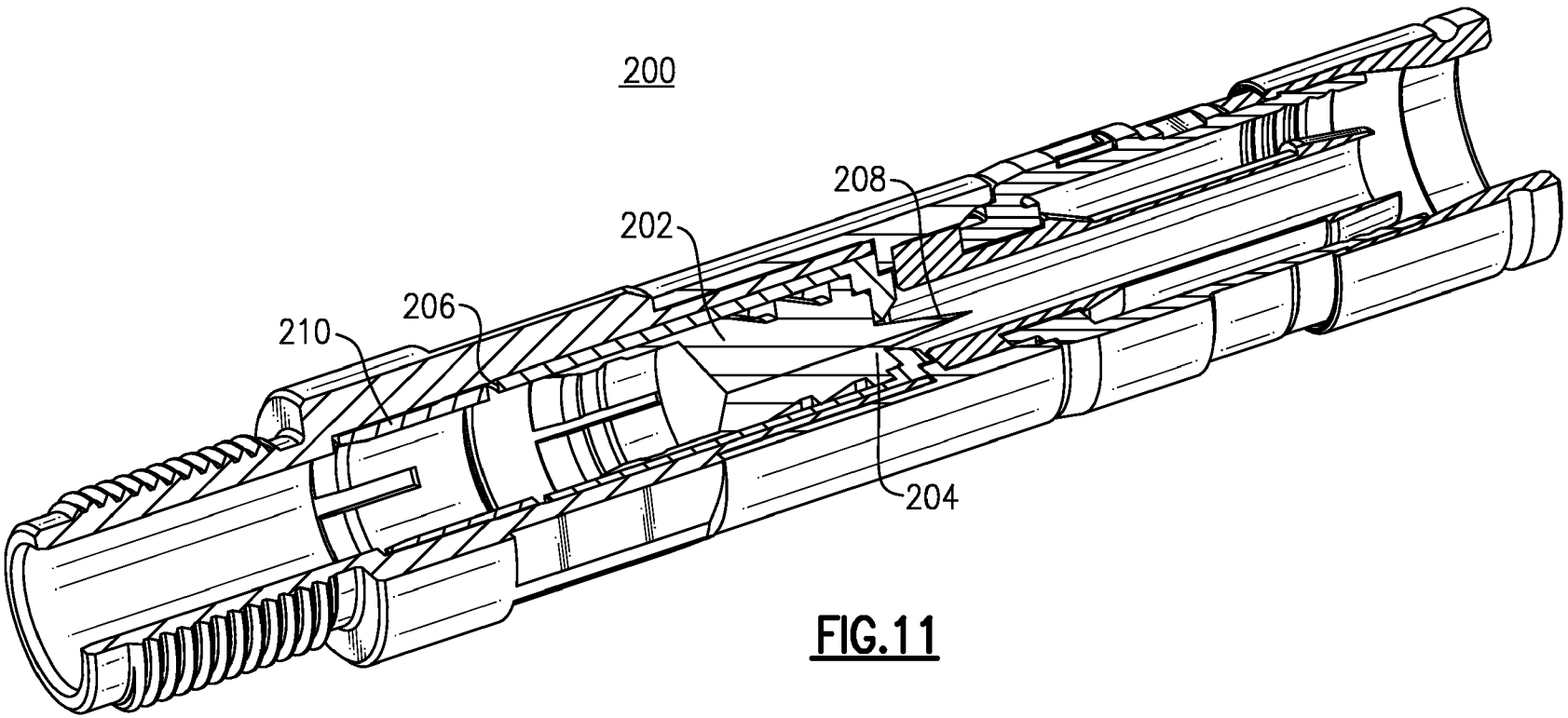
FIG. 11 is a perspective view of another embodiment of the audio jack connector device of the present invention.

Reference is made to FIG. 11, which shows another example of an audio jack connector device 200 having a contact body 202 for making electrical contact with a center conductor. Contact body 202 includes a first end 204 and a second end 206. First end 204 includes a spiked contact 208 extending from end 204. Spiked contact 208 is used when a cable has a center conductor fabricated of a plurality of strands instead of a single central wire. Spiked contact 208 makes contact with the plurality of strands of the center conductor by piercing the cable and contacting the strands in the center of the cable. The present invention is not limited to a specific type of contact, as discussed above. Device 200 further includes a contact tube 210, which makes contact with a plug inserted into the socket or jack of device 200. Contact tube 210 provides additional electrical contact with the plug, without which, the electrical contact would be made with contact body 206. Contact tube is an optional component to provide electrical contact without having to rely on contact body 206 for contact with the plug.

The strength of the connection between the cable and the connector devices described herein is very good, and may be greater than the breaking strength of the cable itself. Accordingly, the connector devices are able to withstand high stresses and strains during use, e.g., those great enough to break the cable. The cable will typically fail or break before the connector.

It is important to mention that the embodiments of the present invention provide a device having a series of conductors concentrically arranged in the device. The post, the socket body and the retainer of the device can maintain the continuity of the electromagnetic shield provided by the outer conductor of the coaxial cable. The shield extends 360° the full length of the connector, from the post to the outer conductor of the coaxial cable. Additionally, the preassembled unitary construction of the devices prevent loss or mishandling of components during installation.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. An audio jack connector device for a phone plug, the audio jack connector device comprising:
- an audio jack comprising a socket body and
- a connector comprising:
  - a connector body and
  - a fastener,
  - wherein the audio jack and connector comprise a series of conductors concentrically arranged in the audio jack connector device, the series of conductors comprising a contact body located in the audio jack, the contact body configured for engaging and electrically contacting the center conductor of the coaxial cable and a post located in the connector for electrically contacting the at least first conductive sheath;
  - wherein the connector is adapted to connect the audio jack to a coaxial cable, wherein the coaxial cable comprises a center conductor surrounded by at least a first dielectric, the at least first dielectric being surrounded by at least a first conductive sheath, and the at least first conductive sheath surrounded by a protective outer jacket;
  - wherein the connector is adapted to mechanically and electrically connect by compressing the center conductor of the coaxial cable to a first conductor in the series of conductors of the audio jack and connector and the first conductive sheath of the coaxial cable to a second conductor in the series of conductors of the audio jack and connector;
  - wherein the fastener is in operative engagement with the connector body; and
- wherein the connector body is configured for an interference fit with the post; and
- where upon axial advancement of the fastener, the connector securely fastens to the cable by compression.

2. The audio jack connector device of claim 1 provided in a preassembled single unit configuration prior to installation of the cable.

3. The audio jack connector device of claim 1 wherein the strength of the connection between the connector device and the cable is greater than the breaking strength of the cable when the cable is fastened therein.

4. The audio jack connector device of claim 1 wherein the socket body comprises a contact tube for making electrical contact with a phone plug inserted in the socket body.

5. A method of mounting an audio jack connector device to a prepared terminal end of a coaxial cable having a center conductor surrounded by at least a first dielectric, the at least first dielectric being surrounded by at least a first conductive sheath, and the at least first conductive sheath surrounded by a protective outer jacket, the method comprising:

(a) providing an audio jack connector device comprising an audio jack and a connector, wherein the audio jack comprises a socket body and a contact body positioned in the socket body, the contact body configured for engaging and making electrical contact with the center conductor;

wherein the connector comprises a post, connector body, and a fastener, and wherein the post, connector body, and a fastener are configured and dimensioned for an interference fit with each other;

wherein a retainer is configured to join the audio jack to the connector by an interference fit;

wherein the post comprises a first inner cavity;

wherein the outer surface of the post and the inner surface of the connector body comprise a first outer cavity;

(b) separating the center conductor and first dielectric from the at least first conductive sheath and outer jacket of the coaxial cable;

(c) inserting the separated end of the coaxial cable into the fastener when the fastener is in a first position and advancing the cable to insert the center conductor into the contact body for electrical contact with the contact body and the at least first dielectric into the first inner cavity of the post, and wherein the at least first conductive sheath and protective outer jacket are positioned in the first outer cavity between the post and the connector body;

(d) moving the fastener axially from the first position to a second position to seal and grip the at least first conductive sheath and protective outer jacket.

6. The audio jack connector device of claim 1 further comprising a retainer, wherein the retainer joins the connector to the audio jack by an interference or a press fit.

7. The audio jack connector device of claim 6 wherein the post is tubular for receiving the coaxial cable, the tubular post having a first end and a second end, a first flange disposed on the outer surface of the first end and a second flange of greater diameter disposed on the outer surface of the second end;

the connector body positioned radially about the tubular post, wherein the connector body is radially spaced about the post to define a first outer cavity between the post and the connector body, the connector body having a first end and a second end, wherein the second end of the connector body abuts the second flange of the post; and the fastener located radially about a portion of the connector body, the fastener having an internal wall thickness of varying thickness over three sections, wherein the first section has a constant thickness T1, the second section has a tapered thickness T2, and the third section has a constant thickness T3, wherein T1 is greater than T3 and wherein T2 decreased in thickness from T1 to T2, and wherein the fastener engages the connector body at the tapered thickness of the second section when the fastener is in a first position.

8. The audio jack connector device of claim 7 wherein the fastener engages the connector body by interference fit at the first section having thickness T1 when the fastener is in a second position, wherein the fastener radially compresses the connector for a compressed fit with the cable in the second position.

9. The audio jack connector device of claim 1 wherein the audio jack further comprises an insulator sandwiched between the contact body and the socket body.

10. The audio jack connector device of claim 6 wherein the post is tubular for receiving the coaxial cable, the tubular post having a first end and a second end, a first flange disposed on the outer surface of the first end and a second flange of greater diameter disposed on the outer surface of the second end;

the connector body positioned radially about the tubular post, wherein the connector body is radially spaced about the post to define a first outer cavity between the post and the connector body, the connector body having a first end and a second end;

wherein the second end of the connector body abuts the second flange of the post;

the fastener located radially inside a portion of the connector body, the fastener having an internal wall thickness of varying thickness over three sections, wherein the first section has a tapered thickness T1, the second section has a constant thickness T2, and the third section has a tapered thickness T3, wherein thickness T3 is less than thickness T1; and wherein the connector body engages the fastener by interference fit when a cable is disposed in the connector and the fastener is in a second position, the fastener radially compresses the cable for a compressed fit with the cable.

11. The audio jack connector device of claim 1 wherein the post is tubular for receiving the coaxial cable, the tubular post having a first end and a second end, a first flange disposed on the outer surface of the first end and a second flange of greater diameter disposed on the outer surface of the second end;

the connector body having a first end and a second end, a first portion of the first end of the connector body radially spaced about a first portion of the tubular post to define a first outer cavity between the post and the connector body, a second portion of the first end of the connector body configured to fit by interference with a second portion of the tubular post, the second end of the connector body radially disposed on a portion of the socket body, the connector body configured to fit by interference with the socket body;

the fastener located radially inside a portion of the connector body, the fastener having an internal wall thickness of varying thickness over three sections, wherein the first section has a tapered thickness T1, the second section has a constant thickness T2, and the third section has a tapered thickness T3, wherein thickness T3 is less than thickness T1; and wherein the connector body engages the fastener by interference fit when a cable is disposed in the connector and the fastener is in a second position, the fastener radially compresses the cable for a compressed fit with the cable.

12. The audio jack connector of claim 1 further comprising a nut for mechanically connecting the connector to a panel.

13. The audio jack connector device of claim 1 wherein a continuous protective shield from electrical interference is provided the length of the connector device when the connector device is in an installed configuration.

* * * * *